United States Patent [19]

Cryder et al.

[11] 3,967,534

[45] July 6, 1976

[54] HYDRAULIC CONTROL SYSTEM WITH SEQUENCE HYDRAULIC JACKS

[75] Inventors: John R. Cryder; Edward A. Wirtz, both of Joliet, Ill.

[73] Assignee: Caterpillar Tractor Co., Peoria, Ill.

[22] Filed: Oct. 25, 1974

[21] Appl. No.: 517,946

[52] U.S. Cl. ..... 91/189 R; 91/412; 91/461

[51] Int. Cl.[2] ..... F15B 11/20; F15B 13/07

[58] Field of Search ..... 91/189 R, 189 A, 412

[56] References Cited

UNITED STATES PATENTS 3,815,472 6/1974 Schantz ..... 91/189

*Primary Examiner*—Paul E. Maslousky
*Attorney, Agent, or Firm*—Phillips, Moore, Weissenberger, Lempio & Strabala

[57] ABSTRACT

A hydraulic control system having a plurality of hydraulic motors is provided with a sequencing control means for sequentially controlling or operating the motors from a single selector valve. The selector valve is operative to direct pilot fluid through a sequential controlling valve for pilot operation of separate pilot-operated control valves for the separate motors. The sequential control valve is operative to direct the fluid for operation of one of the control valves first for full operation of the first motor and then for directing pilot fluid to the second valve for operating the second motor. For operating the motors in the reverse direction, the second control valve is operative to control the second motor to its fully retracted position and then the first control valve becomes operative until the first motor is fully retracted.

8 Claims, 1 Drawing Figure

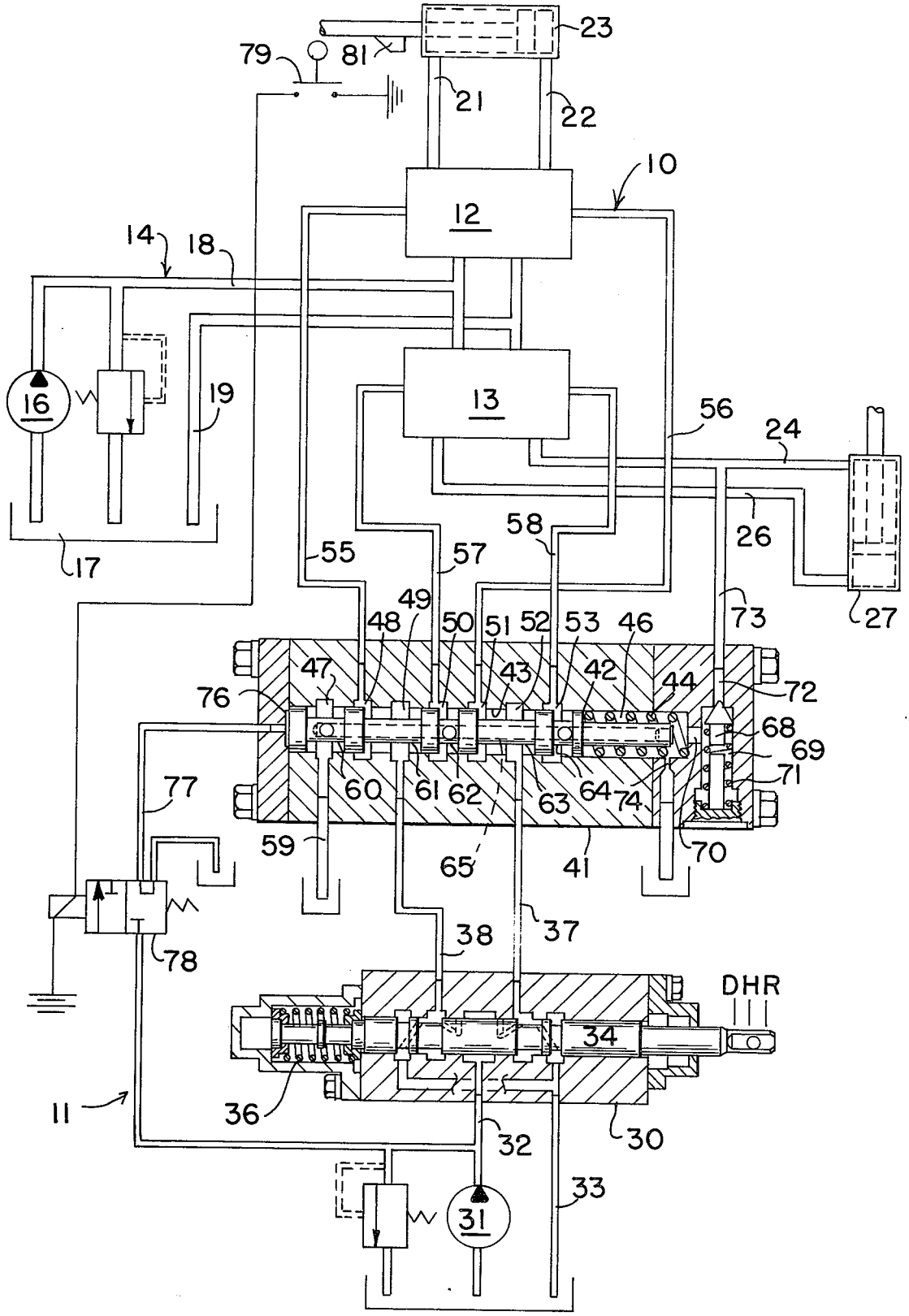
23
79
81
21
22
10
12
14
18
16
19
13
56
24
26
58
55
57
17
27
73
49
48
50
51
52
53
46
47
43
42
44
72
76
68
69
71
77
60
61
62
63
64
74
59
65
41
70
38
37
78
DHR
34
11
36
32
30
33
31

HYDRAULIC CONTROL SYSTEM WITH SEQUENCE HYDRAULIC JACKS

BACKGROUND OF THE INVENTION

The present invention is directed to hydraulic systems and particularly to a sequential control system operative to cause the operation of a plurality of motors in sequence.

Modern earth-working machines normally include a number of earth-working implements, each operated by its own control system by separate control valves, each of the separate control valves normally operated by means of a separate control lever. In many instances the efficiency of the operator of the machine and the output of the machine can be greatly increased by combining separate work functions into a single hydraulic circuit so that, for example, two work functions are performed automatically by the same control lever at a preset sequence. One example of a machine that could be improved in this manner is a loader having an ejector bucket. Such loaders normally employ a hydraulically actuated ejector bucket where the bucket is racked forward to a dump position with one or more hydraulic jacks, while a second hydraulic jack is employed for moving the ejector forward. After the bucket is emptied, the ejector is retracted and the bucket is racked back to its loading position.

Other types of machines having such a preset sequence of operation could also advantageously employ such a control system for sequential operation as is herein proposed.

SUMMARY AND OBJECTS OF THE INVENTION

It is primary object of the present invention to provide a control system for operating a plurality of hydraulic motors in sequence by means of a single control lever.

Another object of the present invention is to provide a simple and inexpensive control system that is operative to operate at least a pair of hydraulic motors in a preselected sequence from a single control lever.

A further object of the present invention is to provide a sequential control system that is responsive to a single control lever to operate the pair of hydraulic motors in a preset sequence in one direction and in the opposite sequence in a reverse direction.

In accordance with the primary aspect of the present invention there is provided a sequential control system for a pair of hydraulic motors wherein the system is operative to direct fluid for operation of the first of the two motors for full extension thereof, and then automatically operative to operate the second motor for full extension thereof. A further feature of the present invention is that the system is operative in reverse sequence to retract the motors.

BRIEF DESCRIPTION OF THE DRAWING

The above and other objects and advantages of the present invention will become apparent from the following description when read in conjunction with the accompanying drawings wherein the single FIGURE is a schematic layout of the hydraulic system embodying the present invention.

DETAILED DESCRIPTION OF THE PREFERRED EMBODIMENT

Referring now to the drawing, there is illustrated a hydraulic control system generally indicated by the reference numeral 10 and including a pilot circuit generally indicated at 11, which controls the actuation of a pair of pilot-operated control valves 12 and 13 of an implement circuit generally designated by the numeral 14. The implement circuit includes a source of motive fluid comprising a pump 16 which draws fluid from a tank 17 and supplies the fluid under pressure through a conduit 18 to the control valves 12 and 13 which direct the fluid for operation of the respective motors. A return conduit 19 returns the exhausted fluid from the motors to the tank 17. A pair of motor control lines 21 and 22 are operative to communicate fluid from the control valve 12 to the rod end and head end respectively of a hydraulic jack or motor 23. Another pair of motor control lines or conduits 24 and 26 communicate fluid from the second control valve 13 with the rod end and head end respectively of the second hydraulic jack or motor 27.

The pilot control circuit 11 includes a pilot selector valve 30 which is supplied with pilot fluid from a pilot pump 31 by way of a line or conduit 32. The return line 33 is provided for returning exhausted fluid from the valve 30 to a pilot sump. The pilot selector valve is of the usual spool type having a valve spool 34 disposed in a bore in the housing and centered in a neutral or hold position by a suitable resilient mechanism indicated at 36. The spool 34 is operative to selectively direct fluid from the supply line 32 to either one of the pilot control lines 37 and 38. When the spool 34 is shifted to the D position, fluid is supplied through line 37, while the line 38 is communicated with the drain or return line 33. When the spool is shifted to the R position, fluid is directed along pilot control line 38 to the sequence control valve, and the pilot control line 37 is communicated with the return line 33.

A sequence control valve 41 is interconnected intermediate the pilot selector valve 30 and the respective pilot-operated control valves 12 and 13. The sequence control valve 41 is operative to direct pilot fluid from the pilot selector valve 30 to the control valve 12 in a first position for shifting of that valve and is operative in a second position to direct the pilot control fluid to the second pilot operated control valve 13.

The sequence control valve 41 includes a housing having a bore formed therein with a valve spool 42 disposed in the bore and operative to control communication between a pair of inlet passages and first and second pairs of outlet passages to be described. The spool 42 is reciprocably disposed in the bore 43 and is resiliently urged toward the left position by suitable means such as a spring 44 mounted in a chamber 46 formed at the right end of the spool. The bore is provided with a plurality of annuli 47, 48, 49, 50, 51, 52 and 53 which are communicated with the inlet and outlet passages.

The pair of conduits 37 and 38, referred to as inlet conduits or passages because they supply pilot fluid to the valve 41, communicate with the annuli 52 and 49 and the bore thereby. A first pair of outlet conduits, passageways or pilot control lines 55 and 56 communicate between annuli 48 and 51 of the bore and with opposite ends of pilot-operated control valve 12. Similarly, a second pair of passages or pilot control lines 57 and 58 communicate with the bore by means of annuli 50 and 53 and with opposite ends of the second pilot-operated control valve 13. A return line 59 communicates the annulus 47 with the tank or sump 17. The valve spool 42 is provided with a plurality of axially spaced annular grooves 60, 61, 62, 63 and 64 formed thereon with the grooves 60, 62 and 64 being interconnected by means of a common passageway 65.

A poppet valve 68 is in a chamber 69 at the right-hand end of valve 42 and is biased to a closed position by means of a spring 71 for controlling communication between the passage 70 and the passage 72. The passage 72 is connected by means of a conduit 73 with the motor line 24. An orifice or restriction 74 provides restricted communication between the chamber 69 and a return passageway to the tank 17.

An actuation chamber 76 is formed at the left end of the valve spool 42 in the bore 43. Means including a pilot line 77 is operative to communicate pilot fluid which is controlled by a valve 78 which is solenoid-operated for directing fluid from the pilot pump 31 to the left end of the spool 42. The left end of the spool 42 is formed to define a piston on which the fluid acts for shifting the spool to the rightward position. An electrical circuit, including a normally open electrical switch, which is positioned adjacent to a cam 81 secured or connected in an operative manner to the rod of the jack 23. The cam is operative to engage and actuate the switch 79 to complete a circuit for operation of the solenoid valve 78 when the jack is extended to a predetermined position.

OPERATION

In order to extend the hydraulic jacks 23, 27, a selector valve 30 is manually actuated to the D position to direct pilot fluid through line 37 to the sequencing valve 41. As will be noted, the switch 79 is in the open position when the jack 23 is in its retracted position as shown, so that the solenoid valve 78 is in the position shown for blocking fluid flow from the pilot pump through line 77 to the chamber 76. Thus, in this condition, the valve spool 42 of the sequencing valve is in the position shown and communicates the pilot fluid from the supply line for inlet passage 37 by way of annulus 51 and line 56 to actuate the control valve 12. With the valve spool in the illustrated position, fluid flow to lines 57 and 58 is blocked while line 55 is communicated with the return line by way of valve 30 to tank 17. Actuation of the valve 12 is operative to direct fluid from the main motor supply line 18 to the head end of the jack 23 by means of conduit 22 to extend the jack outward.

When the jack has extended to a predetermined position such that cam 81 engages and closes switch 79, the circuit is completed, causing an actuation of the solenoid valve 78 to open and permit pilot fluid from the pilot supply pump 31 to flow through the line 77 to the chamber 76. The fluid in the chamber 76 acts on the left end of spool 42, moving it to the right against bias of spring 44, with the fluid in chamber 46 being vented by way of orifice 74 to tank 17. This movement of spool 42 to the right provides communication between the line 37 and the line 58 to actuate the control valve 13 and communicate line 56 to the drain line 59 through annular groove 62 and passageway 65, permitting the control valve 12 to return to its neutral position to block fluid flow therethrough.

Actuation of the control valve 13 directs fluid from the conduit 18 through the conduit 26 to the head end of the jack 27, causing it to extend. When this jack 27 is fully extended, the selector valve 30 is manually returned to its neutral or hold H position.

In order to retract the hydraulic jacks 23 and 27 from their extended position, the selector valve 30 is actuated to the R position to direct pilot fluid through the conduit 38 to the sequencing valve 41. Since the hydraulic jack 23 is in the extended position, the switch 79 remains closed and the solenoid valve 78 is in the actuated position with pilot fluid passing therethrough to chamber 76 to maintain the valve spool in its rightward position. Thus, the line 38 is communicated with the annulus 50 and line 57 to actuate the control valve 13 which directs fluid from the conduit 18 through conduit 24 to the rod end of hydraulic jack 27, causing it to retract. When the hydraulic jack 27 is fully retracted, the fluid pressure in the conduit 24 increases significantly and such fluid pressure is transmitted by way of line 73 and port 72 to unseat the poppet valve 78 to communicate the fluid with chamber 46. The fluid pressure in the implement circuit, being significantly higher than the fluid pressure in the pilot circuit, moves the valve spool 42 to the left position as shown.

In this leftward position the line 38 is then communicated with line 55 to actuate the control valve 12 while the line 57 is connected to a drain line 59 through the annular groove 62 and passageway 65, permitting the control valve 13 to return to its neutral position. The restriction of orifice 74 prevents a rapid depressurization of the chamber 46 so that the valve spool 42 is momentarily maintained in its leftward position. Actuating the control valve 12 directs fluid from the conduit 18 to the conduit 21 to the rod end of jack 23, causing it to retract.

After a short retraction of the hydraulic jack, the cam 81 moves away from the switch 79 permitting it to open and de-energizing the solenoid valve 78 to block the flow of fluid to the chamber 76, thereby permitting the spring 44 to retain the spool 42 in its leftward position. When the hydraulic jack is retracted to a desired position, the selector valve 30 is manually actuated to the hold position to connect the line 38 and thus line 55 with tank 17, while permitting the control valve 12 to return to its neutral position to block fluid flow thereto.

From the above description, it is seen that we have provided a novel sequentially operated control system for sequentially operating a pair of hydraulic motors. The control system is such as to automatically sequentially operate the hydraulic motors in both the extended and retracted positions. This operation is accomplished by means of a single control lever operating on a single pilot selector valve.

We claim:

1. A control system for sequential operation of a plurality of hydraulic motors, said system comprising:
   - at least a first and a second hydraulic motor;
   - a source of motive fluid for operation of said hydraulic motors;
   - sequence control means including a first and a second pilot-operated control valve for directing said motive fluid to and from said first and said second hydraulic motors for sequential operation thereof;
   - a source of pilot fluid for shifting said valves;
   - a pilot selector valve for selectively directing pilot fluid for shifting said first and said second control valves; and, said sequence control means further including a sequence control valve intermediate said pilot selector valve and said first and second control valves and responsive in a first position for communicating pilot fluid upon movement of said pilot selector valve in a first direction for shifting said first of said control valves first for extension of said first hydraulic motor, and pilot means responsive to extension of said first motor for shifting said sequence control valve to a second position for communicating pilot fluid for shifting the second of said control valves for operation of said second motor in a first direction after said first motor is extended a predetermined amount activating said pilot means, and said sequence control valve in said second position communicating fluid upon movement of said pilot selector valve in a second direction for communicating fluid for shifting said second of said control valves for retraction of said second motor and means responsive to full retraction of said second motor for shfting said sequence control valve to said first position for actuating said first control valve for retraction of said first motor.

2. The control system of claim 1 wherein;

said pilot means includes position-responsive switch means responsive to the extended position of said first hydraulic motor for shifting a pilot valve for directing pilot fluid for actuation of said sequence valve to a position directing said pilot fluid to said second control valve.

3. A control system for sequential operation of a plurality of hydraulic motors, said system comprising:

at least a first and a second hydraulic motor;

a source of motive fluid for operation of said hydraulic motors;

sequence control means including a first and a second pilot-operated control valve for directing said motive fluid to and from said first and said second hydraulic motors for sequential operation thereof;

a source of pilot fluid for shifting said valves;

a pilot selector valve for selectively directing pilot fluid for shifting said first and said second control valves;

a sequence control valve intermediate said pilot selector valve and said first and second control valves including a body having a cylindrical bore therein;

a pair of inlet passages communicating with said bore intermediate the ends thereof;

a first pair of outlet passages communicating with said bore and the ends of said first control valve;

a second pair of outlet passages communicating with said bore and the opposite ends of said second control valve; and, a valve spool reciprocally disposed in said bore and operative in a first position to provide communication between said inlet passages and said first pair of outlet passages for directing said pilot fluid for shifting one of said control valves first, and operative in a second position to provide communication between said inlet passages and said second pair of outlet passages for shifting the other of said control valves after the motor controlled by said first valve is operated a predetermined amount.

4. The control system of claim 3 wherein said sequence control valve includes means normally biasing said valve spool to said first position.

5. The control system of claim 4 comprising a pressure chamber formed at each end of said bore;

means defining a piston on each end of said spool;

means for selectively communicating pilot fluid to one of said chambers for biasing said spool to said second position.

6. The control system of claim 3 wherein:

said motors are linear hydraulic motors; and, said sequence control means includes position-responsive means responsive to the extended position of said first hydraulic motor for actuation of said sequence valve to a position directing said pilot fluid to said second control valve.

7. The control system of claim 6 wherein:

said position-responsive means comprises position-responsive valve means responsive to the extended position of said first motor for directing pilot for shifting said sequence control valve to said second position.

8. The control system of claim 7 wherein:

said position-responsive valve means is a solenoid operated valve and switch means operated by cam means on said first motor for controlling electrical circuit means for operating said solenoid operated valve.

* * * * *